US005899366A

United States Patent [19]

Ellion

[11] Patent Number: 5,899,366

[45] Date of Patent: May 4, 1999

[54] LEAK-RESISTANT HAND-PUMP SPRAY BOTTLE

[76] Inventor: M. Edmund Ellion, 3660 Woodstock Rd., Santa Ynez, Calif. 93460

[21] Appl. No.: 08/949,418

[22] Filed: Oct. 14, 1997

[51] Int. Cl.[6] ..... B67D 5/40

[52] U.S. Cl. ..... 222/376; 222/377; 222/382

[58] Field of Search ..... 222/376, 382, 222/383.1, 377, 481.5, 402.19, 464.7

[56] References Cited

U.S. PATENT DOCUMENTS

| | | | |
|---|---|---|---|
| 5,467,901 | 11/1995 | Foster et al. | 222/376 |
| 5,624,060 | 4/1997 | Ellion et al. | 222/464.7 |
| 5,657,909 | 8/1997 | Barriac | 222/382 |

*Primary Examiner*—Philippe Derakshani
*Attorney, Agent, or Firm*—Watson Cole Grindle Watson, P.L.L.C.

[57] ABSTRACT

A hand pump spray bottle does not leak the liquid contents through the air inlet port during operation when the bottle is oriented so that the inlet port is covered with liquid. The air inlet port is in circuit with an optional void volume which in turn is in fluid communication with the interior of the bottle through a tubular section. The void volume, where present, and the tubular section act as a reservoir to store the liquid from the bottle that would normally reach the air inlet port. When the hand pump is operated, liquid is removed from the bottle and the pressure therein decreases. When the pressure within the bottle decreases to a value that is equal to the atmospheric pressure minus the product of the density of the liquid contents times the height of the liquid above the air inlet port, atmospheric air will force the liquid in the void volume, where present, and the tubular section back into the bottle and atmospheric air then can enter the bottle to maintain the pressure substantially constant thereafter.

28 Claims, 5 Drawing Sheets

LEAK-RESISTANT HAND-PUMP SPRAY BOTTLE

BACKGROUND OF THE INVENTION

This invention relates to hand-pump spray bottles for dispensing a liquid in a jet or atomization mode and, more particularly, to such a bottle having a novel air inlet unit that prevents the liquid contents from leaking out of the air inlet unit when the container is operated at an orientation that causes the air inlet unit to be covered with liquid.

Hand-pump spray bottles have become increasingly popular to eliminate the use of pressurized cans due to environmental concerns and high cost. Over one billion spray bottles are sold each year to dispense such liquids as glass cleaners, bathroom cleaners, waxes, and oils.

These spray bottles have a feed tube with an open end entrance that extends into the liquid contents and serves as a conduit to the hand pump. There is an air inlet port, usually located in the hand pump, that admits air into the bottle when the pump is operated. This admitted air replaces the liquid that is dispensed, in order to maintain approximately atmospheric pressure within the bottle. These spray bottles operate well under some conditions. However, if the feed tube entrance is within the liquid and the air inlet port is covered with liquid, as would occur when the bottle is operated at certain commonly encountered orientations, the hand pump will dispense the liquid satisfactorily but liquid will leak out of the air inlet port. This leakage occurs with conventional spray bottles as well as with any of the numerous bottles that can operate in the inverted position, such as described in U.S. Pat. Nos. 3,733,013; 4,775,070; and 5,624,060. This leakage is highly undesirable for any liquid since it is unpleasant to wet the hand, and it is a waste of product. Any leakage, even the smallest amount, is completely unacceptable for any caustic liquids.

It is the principal object of this invention to provide an air inlet unit that will admit air to a hand-pump spray bottle but will prevent leakage of the liquid contents when the bottle is operated in an orientation where the air inlet port is covered with liquid.

It is another object of this invention to admit sufficient air to maintain the air pressure within the bottle at a level that will prevent it from collapsing any appreciable amount.

It is yet another object of this invention for the air inlet unit to operate without any moving parts.

Still another object of this invention is to provide an air inlet unit that will increase the cost of the entire bottle assembly only a negligible amount.

It is still another object of this invention to provide a single design for the air inlet unit that will operate with any dispensable liquid.

It is a further object of this invention to incorporate the air inlet unit into the hand pump without any additional assembly steps.

Other objects and advantages of this invention will become apparent from the teachings of the following specification and appended drawings.

SUMMARY OF THE INVENTION

This invention is directed to a hand-operated spray bottle and an air inlet port for such a spray bottle, that will allow air to enter in order to replace the dispensed liquid but will prevent liquid from leaking out of the port when the bottle is oriented so that the port is covered by liquid. The preferred hand pump has a piston that draws the liquid into a cylinder during the suction stroke and also uncovers the air inlet port to the atmosphere. During the returning stroke of the piston, the liquid is dispensed out of the hand pump and the air inlet port is again covered by the piston to prevent liquid leakage if the bottle is stored at an orientation where the air inlet port is covered with liquid.

In one embodiment, the air inlet port of this invention is in circuit with a tubular section having a maximum internal dimension and a minimum length, which has an open end in fluid communication with the interior of the bottle. When the bottle is not operated and is oriented so that liquid covers the tubular section, liquid enters the tubular section until the air contained therein is compressed to a pressure that is very nearly equal to the atmospheric pressure plus the product of the density of the liquid times the height of the liquid level above the air inlet port. The tubular section is sufficiently long so that the liquid does not completely fill it. When the hand pump is operated, the pressure within the bottle decreases, because some of the liquid has been removed from the bottle. The pressure of the air within the tubular section exceeds the atmospheric pressure causing some of the air to be released to the atmosphere when the air inlet port is uncovered, resulting in a lower pressure within the tubular section. The air inlet port is sized so that the decrease in pressure within the inlet port is equal or smaller than the decrease in pressure within the bottle. The result is that some of the liquid within the tubular section is forced back into the bottle following the first stroke of the hand pump. When the pressure within the bottle decreases by an amount that is slightly greater than the product of the liquid density times the height of the liquid above the air inlet port, atmospheric pressure can force air into the air inlet port and the tubular section and thus into the bottle to maintain substantially constant pressure thereafter. Since the pressure within a full bottle at this time is only about 0.27 psi below atmospheric pressure for most bottle contents, the bottle will not collapse by any noticeable amount. This is the most severe collapsing force, because the pressure that is required within a nearly empty bottle to allow air to enter the bottle is very close to atmospheric pressure.

The maximum desired diameter of the tubular section of the air inlet port is that which will not allow air that is in the tubular section to bubble through the liquid contents that has entered the tube. For most liquids dispensed by spray bottles, this diameter of the tubular section should be less than about 0.25 inch.

The above and other features of the invention will be fully understood from the following detailed description and the accompanying drawings.

BRIEF DESCRIPTION OF THE DRAWINGS

FIG. 1(*b*) is a sectional view of a conventional Continental Spray, Inc. handpump spray head;

FIG. 1(*c*) is a side elevational view, with a portion shown in cutaway cross section, of a second conventional AFA Corporation hand-pump spray head, and FIG. 1(*d*) is an enlarged sectional view of the spray head of FIG. 1(*c*), taken along lines 1(*d*)—1(*d*);

DETAILED DESCRIPTION OF THE INVENTION

Figure 1A:
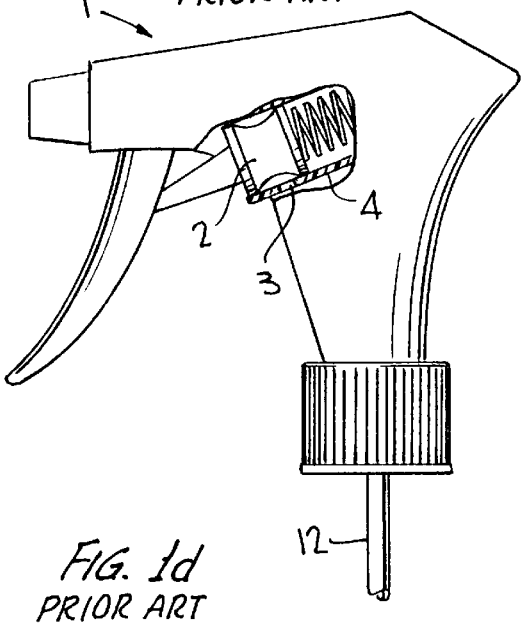
FIG. 1a PRIOR ART
FIG. 1(*a*) is a side elevational view, with a portion shown in cutaway cross section, of a first conventional AFA Corporation hand-pump spray head.
Figure 1B:
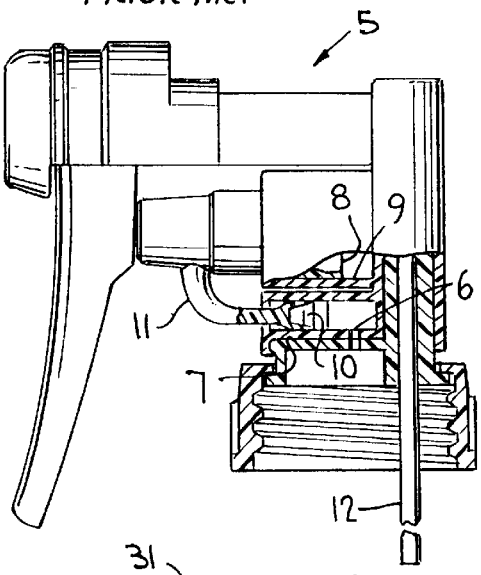
FIG. 1b PRIOR ART
Figure 1D:
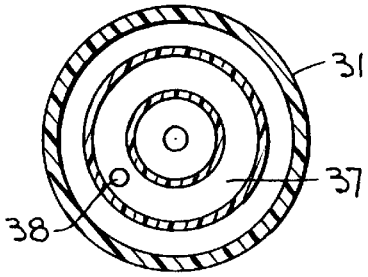
FIG. 1d PRIOR ART
Figure 1C:
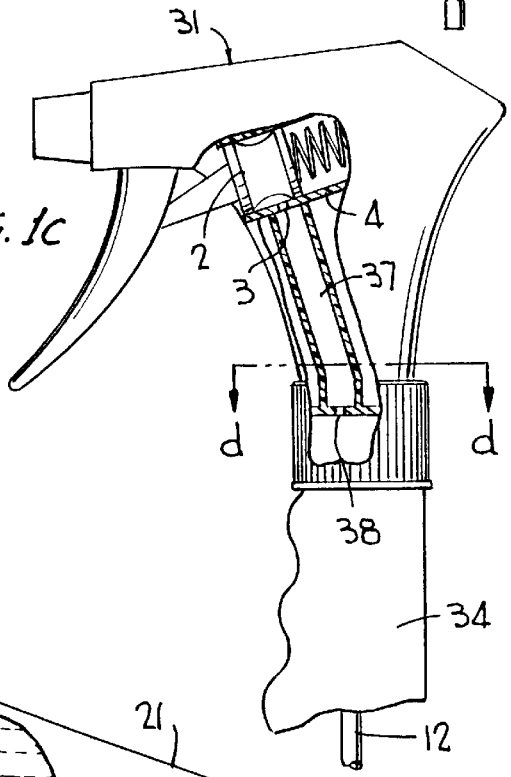

FIG. 1(*a*) illustrates a conventional hand pump 1, made by AFA Corporation, Forest City, N.C., in which is located a piston 2 which, when operated by a hand trigger, pumps the liquid contents out of a bottle. The piston 2 covers an air inlet port 3 in a mating cylinder 4 when not operating. During the suction stroke of the piston 2, some of the liquid within the closed bottle is drawn through a feed tube 12 into the cylinder 4. The removal of liquid from the closed bottle causes a reduction in the internal pressure within the bottle, which would, if allowed to continue, ultimately result in a collapse of the bottle. To avoid the gradual reduction in the internal pressure within the bottle, the air inlet port 3 is uncovered when the piston 2 is operated, allowing air to enter the bottle to replace the liquid which was dispensed and, consequently, maintain the pressure within the bottle substantially at atmospheric pressure.

FIG. 1(*b*) illustrates another hand pump 5, made by Continental Sprayers, Inc., St. Peters, Mo., in which an air inlet port 6 is located in a separate cylinder 7 from the main liquid pumping piston 8 and the cylinder 9. In this case, the separate air piston 10 is connected by an arm 11 to the main piston 8. This hand pump 5 functions in substantially the same manner as the hand pump 1 of FIG. 1(*a*).

FIG. 1(*c*) and FIG. 1(*d*) illustrate another common version of the hand pump in which there are two orifices. One orifice is the air inlet port 3 and the other orifice 38 is located at the sealing surface between the hand pump and the spray bottle. Between the two orifices is an annular air passage 37 to enable the atmospheric air to reach the interior of the spray bottle.

Figure 2:
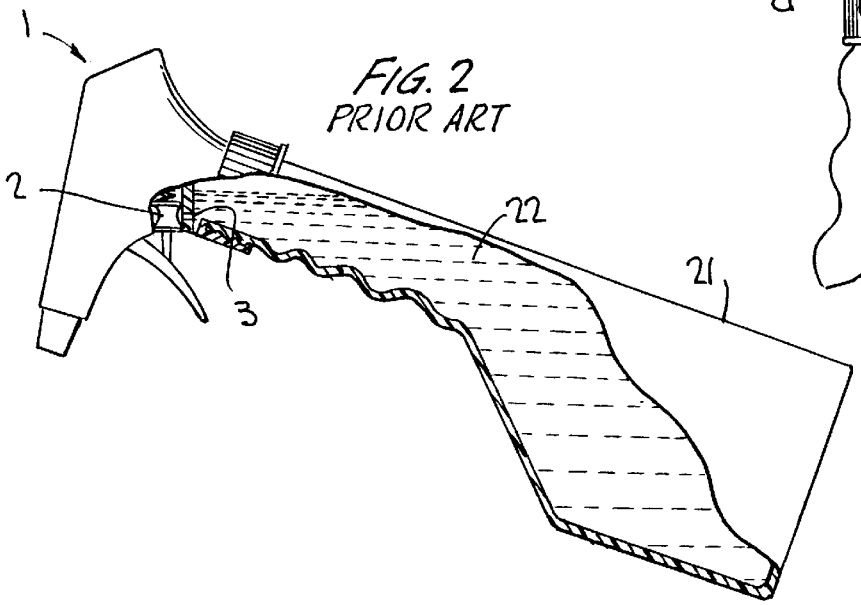
FIG. 2 PRIOR ART
FIG. 2 is a side elevational view, with a portion shown in cutaway cross section, of a bottle using a hand-pump spray head in a tilted orientation.

FIG. 2 illustrates the conventional spray bottle 1 oriented so that the air inlet port 3 is covered with the liquid 22 in a bottle 21, a commonly experienced situation when spray bottles are tilted in use. The pressure of the liquid at the air inlet port 3 is greater than the atmospheric pressure by the product of the density of the liquid 22 times the height of the head of liquid above the air inlet port 3. When the hand pump is operated, the air inlet port 3 is uncovered and liquid 22 flows by the force of gravity out of the bottle 21 through the air inlet port 3. This result is highly undesirable, since the liquid 22 passing through the air inlet port 3 flows onto the hand of the operator. If the liquid 22 is caustic or adversely affects the skin of the hand in any way, the leakage is not only unpleasant but wasteful of the product and potentially dangerous. The rate at which the liquid 22 leaks out of the bottle 21 increases as the head of the liquid over the air inlet port 3 increases, being a maximum when the bottle is fully inverted to a vertical orientation.

The conventional bottle 1 and other conventional bottles such as shown in FIG. 1 are not satisfactory when the liquid covers the air inlet port and leaks out of the bottle onto the hand of the operator during service. It is highly desirable to have an air inlet port design that will not allow liquid to leak out through it and will allow air to enter the bottle when the air inlet port configuration is covered with liquid.

The following nomenclature is used in describing the elements of the invention. The "air inlet port" designates the orifice through which air is admitted through the hand pump to the interior of the spray bottle. The "tubular section" is a tube in fluid with the air inlet port and the interior of the spray bottle. The "void volume", which is present in some embodiments, is a volume of any shape that acts as an additional reservoir for liquid during inverted operation. The "air inlet unit" is the combined elements including the air inlet port, the void volume (where present), the tubular section, any tubular extension of the air inlet port and the entrance for admitting air between the hand pump and the interior of the bottle. "Upright" refers to the orientation of the spray bottle when the air inlet unit is not in contact with the liquid within the bottle, and "inverted" refers to the orientation of the spray bottle when the air inlet unit is covered with liquid.

Figure 3:
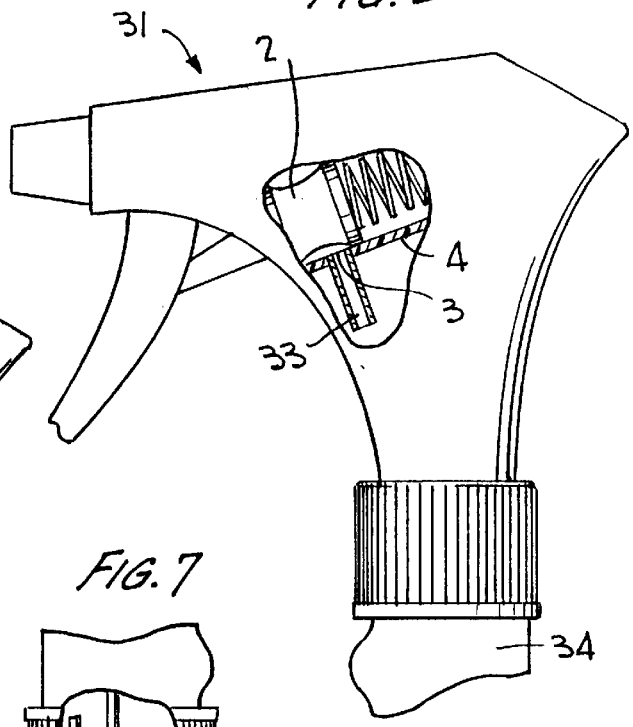
FIG. 3 is a side elevational view, with a portion shown in cutaway cross section, of a bottle and hand-pump spray head in accordance with the invention.
Figure 8:
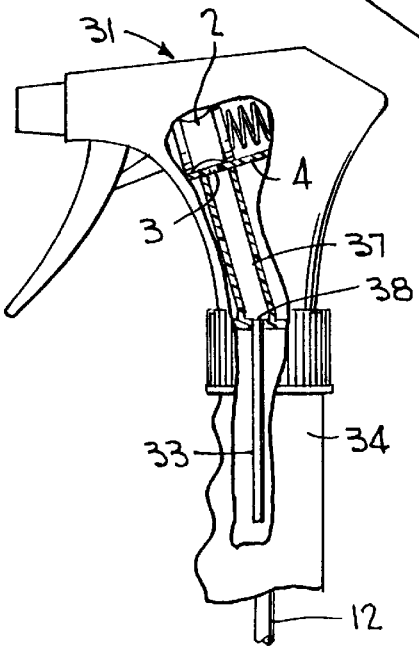
FIG. 8 is a side elevational view, with a portion shown in cutaway cross section, of a bottle wherein the tubular section extends into the spray bottle.

FIG. 3 illustrates a hand pump 31 utilizing one embodiment of the air inlet unit of the present invention. The air inlet unit includes an air inlet port 3 like that of conventional units, but additionally has a tubular section 33 located within the hand pump in communication between the air inlet port 3 and the interior of the spray bottle. The tubular section 33 may be circular in cross-section or any other shape as long as the diameter and length (volume) are chosen as discussed subsequently. For the type of hand pump illustrated in FIG. 1(*c*) where the hand pump fluid communication interface within the interior of the spray bottle is located at the sealing surface between the pump and the bottle, the tubular section 33 extends into the interior of the spray bottle as illustrated in FIG. 8. The following discussion will focus on the embodiment of FIG. 3, but the invention is applicable to other configurations such as those of FIGS. 1(*a*)–1(*d*).

FIGS. 4(*a*)–4(*d*) illustrate the functioning of the air inlet unit with the tubular extension 33 when the bottle is in the inverted position. The pressure of the air in an air space 35 above the liquid 36 in the bottle is assumed to be atmospheric initially, as would be the case if the hand pump were operated just previously in the upright position. Some of the liquid 36 is forced into the tubular section because of the head of liquid, FIG. 4(*a*). The volume of air in the tubular section 33 is compressed to increase its pressure by an amount equal to the density of the liquid 36 times the height of the head of liquid over the inlet port 3. When the hand pump is operated, some of the liquid in the bottle is dispensed and the pressure of the air 35 within the bottle decreases. Approximating the process as isothermal, the new pressure is equal to the atmospheric pressure times the ratio of the original air volume to the new air volume. Simultaneously, some of the air in the tubular section 33 is released to the atmosphere when the air inlet port 3 is uncovered, resulting in a lower pressure. For a proper relation between the quantity of liquid dispensed and the quantity of air that is released, some of the liquid in the tubular section will be forced back into the bottle, as illustrated in FIG. 4(*b*).

The quantity of air released depends upon the pressure of the air in the tubular section 33 and the size of the air inlet port 3. Typical hand pumps (such as the those of AFA Corporation) have air inlet port diameters of 0.050 inches and discharge approximately 0.06 cubic inch of liquid for each stroke. For this typical hand pump, two strokes of the hand pump are required to decrease the pressure within a new bottle containing the initial volume of liquid by an amount equal to the product of the density of the liquid times the liquid height above the air inlet unit. At this point, atmospheric air can enter the bottle. FIG. 4(*b*) illustrates the liquid level in the tubular section after one stroke of the hand pump. FIG. 4(*c*) illustrates the liquid level in the tubular section after two strokes of the hand pump. All of the liquid that was in the tubular section has been returned to the bottle. FIG. 4(*d*) illustrates the atmospheric air entering the bottle during the third stroke of the hand pump.

Figure 5:
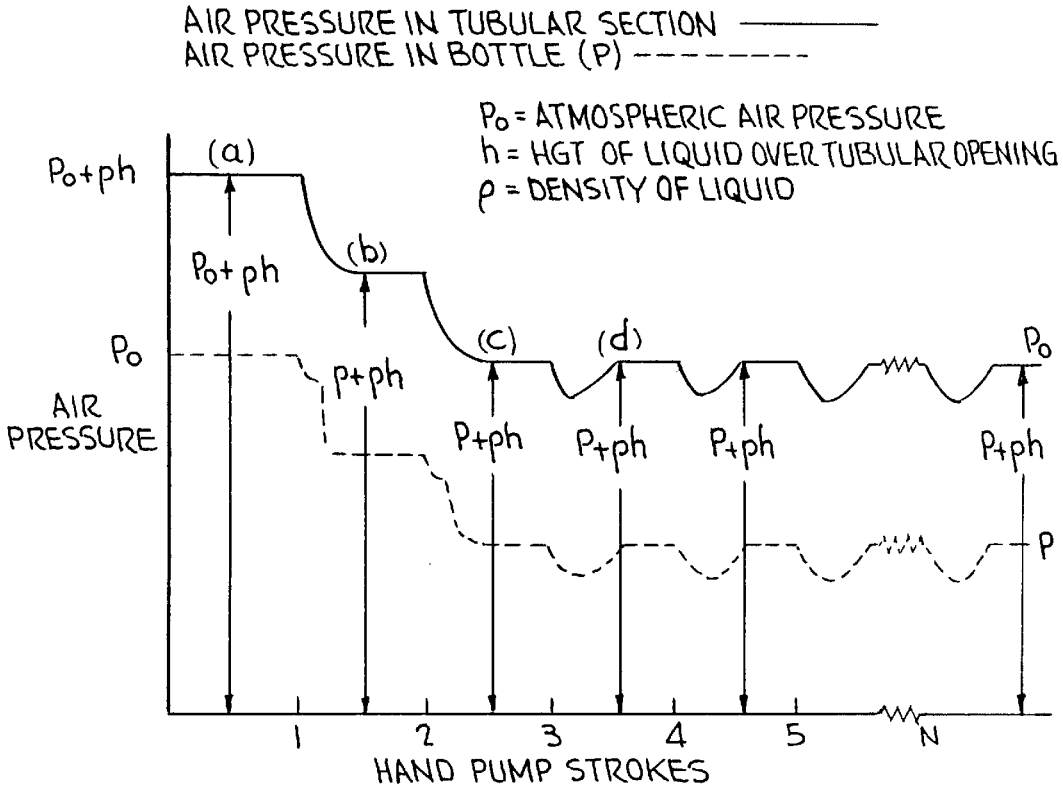
FIG. 5 is a graph illustrating the pressure in the air inlet unit and the pressure in the bottle as a function of the number of hand strokes for a properly sized air inlet port in relation to the quantity of liquid that is dispensed per stroke.

The air inlet port 3 with the tubular section 33 of the invention operates in the same manner as the conventional orifice-type air inlet port when the air inlet port 3 is not covered with liquid. When the air inlet port 3 is covered with liquid, the tubular section 33 acts as a reservoir to produce an air seal between the liquid and the inlet port in order to prevent liquid leakage. The pressure in the tubular section decreases monotonically during the first stroke when the air inlet port is uncovered and air from the tubular section is released to the atmosphere. The pressure in the air space 35 of the bottle decreases a slight amount during the time that the piston in the hand pump first uncovers the air inlet port to allow some air to be released form the tubular section. During that time a slight amount of liquid from the bottle interior flows into the tubular section 33 to replace the released air and thus lower the pressure in the bottle slightly. When the piston in the hand pump returns to the original position (suction stroke), liquid is withdrawn from the interior of the bottle and into the hand pump cylinder. The removal from the bottle interior of his relatively large amount of liquid causes the air pressure in the bottle to decrease a greater amount than previously. The sketches in FIG. 4 illustrate the final liquid-air interface positions at the end of each stroke. FIG. 5 will show the detailed pressure variations during the strokes.

The proper design for the minimum size of the air inlet unit during inverted operation has three basic requirements: (1) only a portion of the air in the tubular section is allowed to be released to the atmosphere for each stroke of the hand pump until the pressure in the bottle decreases to the value equal to atmospheric pressure minus the product of the density of the liquid within the bottle times the height of the liquid over the air inlet unit, at which time atmospheric air enters the bottle at each stroke of the hand pump; (2) the decrease of the pressure within the tubular section for each stroke of the hand pump must be equal to or small than the decrease of the pressure within the bottle; and (3) the tubular section must be sufficiently small in order that the air within it cannot bubble through the liquid that is in the tubular section and allow the liquid to reach the air inlet port, a phenomenon termed "breakthrough".

The first requirement is satisfied by choosing the proper size of the air inlet port and the proper volume in the tubular section. The diameter of the air inlet port should be as small as is practical to manufacture as long as it will admit sufficient air to keep the bottle from collapsing by any appreciable amount. For example, during inverted operation, the volume of air that is released from the tubular section through an air inlet port having a diameter of 0.010 inch is 0.096 cubic inches per second, as determined by the flow through an orifice using standard fluid mechanics relations assuming the air pressure within the bottle is constant at 14.7 pounds per square inch, the liquid level is 7.5 inches above the air inlet port, and the flow coefficient is 0.6. Assuming that the hand pump is activated at a rate of three strokes per second, the volume of air released from the tubular section to the atmosphere will be 0.096/3=0.032 cubic inches per stroke. If only one stroke of the hand pump is needed to reduce the pressure of the air within the bottle by an amount equal to the density times the height of the liquid above the air inlet port, then the volume of the tubular section must be 0.032 cubic inches. If two strokes of the hand pump are required to reduce the air pressure to the required value, then a tubular section having a volume equal to 2×0.032–0.064 cubic inches is required. The number of strokes of the hand pump to reduce the air pressure is discussed next.

The second requirement is satisfied by having a sufficiently strong hand pump for any given size of air inlet port. For example, if the hand pump is activated three times a second and dispenses 0.06 cubic inches of liquid during each stroke and the air inlet port diameter is 0.010 inches, which allows 0.096 cubic inch per second of air to be released to the atmosphere, the volume of air within the bottle will increase by an amount equal to 0.06+0.096/3=0.092 cubic inches per stroke. The volume of air in a typical new bottle is 3.6 cubic inches. The increase in the air volume, assuming isothermal expansion, would reduce the air pressure within the bottle to (3.6×14.7)/(3.6+0.092)=14.33 pounds per square inch after one stroke of the hand pump. For a liquid height of 7.5 inches, the air pressure within the bottle must be less than the atmospheric pressure minus the product of the liquid density times the height of the liquid (0.036×7.5=0.27 pounds per square inch) or 14.43 pounds per square inch, in order to stop the flow of liquid into the tubular section and allow atmospheric air to enter the bottle. Since the pressure in the bottle after one stroke of the hand pump would be only 14.33 pounds per square inch, atmospheric air would enter the bottle. It is seen for this size of orifice and this hand pump capacity, the tubular section needs to have a volume of 0.092 cubic inches to prevent liquid from leaking during inverted operation.

The third requirement is met by choosing a sufficiently small internal diameter tubular section 33 if it has a circular cross section or a minimum internal dimension if it is oblong in cross section. The specific size depends upon the surface tension of the liquid to be dispensed and the material of construction of the tube. The specific maximum allowable dimension may be calculated if the surface tension of the liquid and the contact wetting angle are known. However, a simple test gives a practical, usable result without calculations. In order to determine the maximum acceptable diameter for the tubular section made of a particular material and using a particular liquid to be dispensed, a series of tubes about six inches long of different diameters are prepared. A tube is held vertically and immersed into a container of the liquid to be dispensed to a depth of about three inches. The top end of the tube is closed, as by holding a finger over the end, to prevent air from entering. The tube is withdrawn from the liquid in the vertical orientation. The level of liquid in the tube falls slightly to create a vacuum in the top section of the tube. If the remainder of the liquid remains in the tube, the tube diameter is satisfactory. If air bubbles into the tube from the lower end so that more liquid escapes, "breakthrough" has occurred and the tube is of too large a diameter to be operable as the tubular section 33. Normally, the largest diameter tube which does not experience breakthrough is selected for any particular application, although smaller diameter tubes are operable as well. Tubes of circular or non-circular cross sections may be checked with this approach. For typical liquids the maximum value of the smallest internal dimension of the tubular section is about 0.25 inches.

FIG. 5 is helpful in understanding the operation of the air inlet unit. The first time that the hand pump is operated in the inverted position after being operated in the upright position, the pressure of the air 35 in the bottle is at atmospheric. The graph of FIG. 5 illustrates the operation of the bottle in the inverted position with the values of the pressure of the air in the air inlet unit and in the bottle when the tubular section has the minimum length that will operate satisfactorily. The pressures are plotted along the ordinate and the number of strokes of the hand pump when operated in the inverted position is plotted along the abscissa. Above the curves that represent the air pressure are letters that correspond to the conditions illustrated in FIGS. 4(*a*), 4(*b*), 4(*c*), and 4(*d*). FIG. 4 illustrated the condition at the end of each stroke, and FIG. 5 illustrates the condition throughout the stroke.

Before the first stroke of the hand pump, the pressure in the air inlet unit is compressed to a value equal to atmospheric pressure plus the product of the density of the liquid in the bottle times the height of the liquid over the air inlet unit. When the piston is moved to uncover the air inlet port during the positive cycle, some of the air in the air inlet unit is released to the atmosphere. This release of air results in a slight decrease in the pressure within the bottle, as indicated, because a relatively small amount of the liquid has left the bottle and entered the tubular section. A short time later, the stroke is completed when the piston is returned to its starting position during the suction cycle and a substantial volume of liquid is drawn out of the bottle and into the hand pump. The result is that the air pressure in the bottle decreases a significant amount.

In order to calculate the required volume of the tubular section 33 it is necessary to know the following properties: the volume of the liquid that is dispensed for each stroke of the hand pump, the volume of air in the bottle, the height of the liquid above the air inlet unit, the volume of air in the air inlet unit, the rate at which the air is discharged from the air inlet unit, the density and the surface tension of the liquid in the bottle, and the time that the air inlet port is uncovered.

Instead of this detailed analysis, the required volume of the tubular section may be estimated by assuming that the hand pump is not drawing any liquid out of the bottle for two strokes of the hand pump. This assumption results in a determination of the volume of the tubular section that is much larger than needed. In this case, the pressure of the air in the bottle would decrease only because of the air that is released through the air inlet port that would allow some of the liquid in the bottle to enter the tubular section and, consequently, decrease the pressure of the air within the bottle. As was seen from the previous discussion, for each stroke of the hand pump, the air released from the tubular section is approximately one-half the volume of liquid that is discharged by the hand pump. As a consequence, estimating the volume of the tubular section by this simple method would be too large by a factor of three. However, because of the simplicity of obtaining the size of the tubular section in this manner and the fact that the walls of the bottles are not rigid, this method is useful. The effect of non-rigid walled bottles is discussed in a later section.

Figure 6:
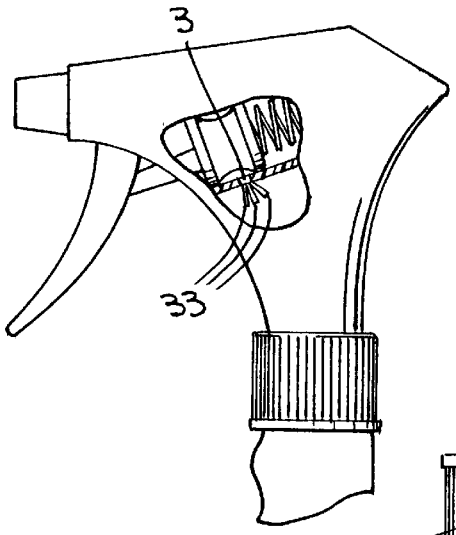
FIG. 6 is a side elevational view, with a portion shown in cutaway cross section, of a bottle having an air inlet unit with multiple tubular sections.

When the bottle is operated so that the air inlet unit is covered with liquid, air does not enter the bottle until the pressure therein falls to a value equal to the atmospheric pressure minus the product of the liquid density times the height of the liquid over the open end of the tubular section 33. In order to determine the required volume of the tubular section, consider the extreme case where no liquid is removed by the hand pump and the air inlet port is uncovered. In that case, some of the liquid from the bottle flows into the tubular section and some of the air in the tubular section is discharged to the atmosphere. When the pressure of the air in the bottle reaches atmospheric pressure minus the product of the liquid density times the height of the liquid over the tubular section open end, the liquid will stop flowing into the air inlet unit. The required minimum size of the tubular section is determined for this case. The initial pressure in the bottle is assumed to be atmospheric ($P_0$), 14.7 pounds per square inch (psi). The initial volume of the air in the bottle is $V_1$. For a typical bottle, the height of the liquid over the tubular section is 5 inches, and the density of the liquid is 0.036 pounds per cubic inch, when the bottle is inverted and is one-half full of liquid. From these data, the pressure in the tubular section 33 is 14.7+(0.036×5)=14.88 psi. Before the atmospheric air may enter the tubular section, the pressure in the bottle must fall below the value 14.7−(0.035×5)=14.52 psi. The ratio of the final volume of air to the initial volume of air in the bottle at the time that atmospheric air can enter, assuming isothermal expansion, is equal to the ratio of the initial pressure to the final pressure or 14.7/14/52=1.012. The volume of air in the bottle must increase by slightly more than one percent in order to lower the pressure to the value where atmospheric pressure can enter and the liquid in the bottle ceases to flow into the tubular section. In order to prevent the liquid from leaking out of the air inlet unit, the tubular section must be sufficiently large to hold all of the liquid that has left the bottle and flowed into the tubular section. This volume equals the change in the volume of the air in the bottle, or about 1.2 percent of the initial volume of the air in this example. The typical 17 fluid ounce bottle has a volume of air of about 18 cubic inches when the bottle is half full. The tubular section must therefore have a volume of about 0.22 cubic inches. As discussed above, the diameter of the tubular section must be sufficiently small that air bubble breakthrough does not occur, which is less than about 0.25 inches in most case. For a tubular section of circular cross section and 0.2 inches inside diameter, the required length of the tubular section is $0.22/(\pi 0.2^2/4)=7.0$ inches. This length of the tubular section cannot be easily accommodated within typical hand pumps. The effective length of the tubular section may be increased by employing multiple tubular segments, such as shown in FIG. 6, in place of the single tubular segment as shown in FIG. 3. Each of the three segments of FIG. 6 need only be ⅓ third the length of a single segment that accomplishes the same function.

Figure 7:
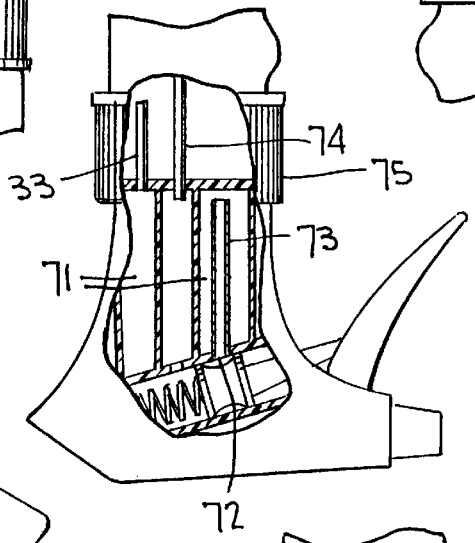
FIG. 7 is a side elevational view, with a portion shown in cutaway cross section, of a bottle using an embodiment of the invention in which the air inlet port is in circuit with a void volume, which is in fluid communication with the interior of the bottle.
Figure 9:
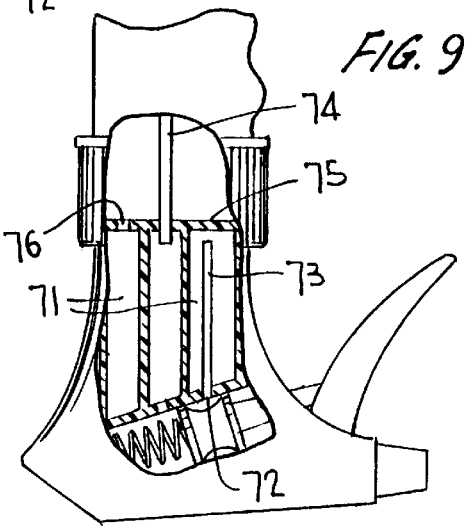
FIG. 9 is a side elevational view, with a portion shown in cutaway cross section, of a bottle wherein the air inlet unit has an orifice in fluid communication with interior cavity of the spray bottle.
Figure 4A:
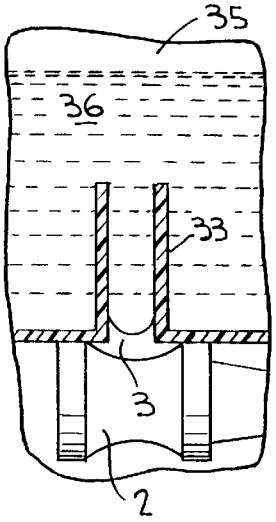
FIGS. 4*a*–4*d* are a series of schematic fragmented drawings showing the operation of the bottle hand-pump spray head of FIG. 3, with the bottle and hand-pump spray head in an inverted orientation, wherein FIG. 4(*a*) illustrates the state prior to a first pumping stroke, FIG. 4(*b*) illustrates the state after the first pumping stroke, FIG. 4(*c*) illustrates the state after the second pumping stroke, and FIG. 4(*d*) illustrates the state after the third pumping stroke.
Figure 4B:
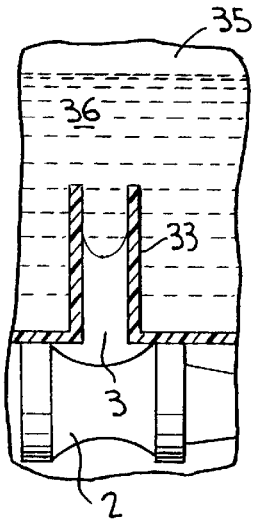
Figure 4C:
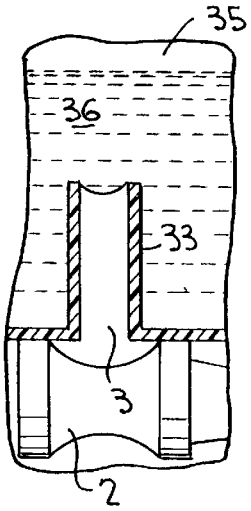
Figure 4D:
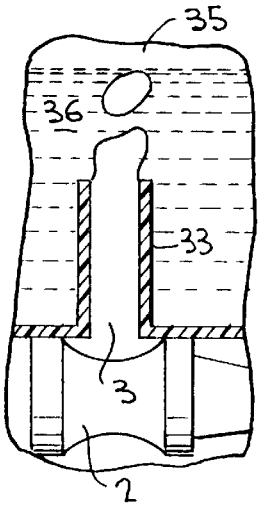

The effective length of the tubular section may also be decreased by employing a large void volume between the air inlet port and the tubular section, as shown in FIG. 7. The tubular section 33 is in series with a larger volume 71. The volume 71 is an annular configuration with fluid communication between the air inlet port 72 and the tubular section 33. The air inlet port 72 has an extension 73 in fluid communication between the air inlet port 72 and the volume 71. When the bottle is inverted vertically and liquid has flowed out of the bottle into the volume 71, the liquid will not reach the air inlet port 72 until the entire volume 71 is full of liquid. When the bottle is held at an angle other than the vertical and if the volume 71 is full of liquid, some of the liquid in the volume 71 may reach the air inlet port. As a result, the volume 71 must be larger than the volume of liquid that will leave the bottle and enter the volume 71 in order to lower the air pressure within the bottle to the level that will allow atmospheric air to enter the bottle. With this approach, the volume 71 accounts for at least part of the required volume of the tubular section 33, so that the tubular section 33 need not be of any specific length. In fact, it may be an orifice of zero length, as illustrated in FIG. 9, if the volume 71 is sufficiently great to act as a reservoir for the liquid that leaves the bottle before the air pressure in the bottle decreases an amount equal to the liquid density times the height of the liquid over the air inlet unit.

The preceding discussion has been concerned with a tubular section 33 whose open end is above the liquid level when the bottle is oriented in the upright position. In that case, when the bottle is inverted, liquid tends to enter the tubular section. The forces causing the liquid to flow into the tubular section result from the pressure difference at the open end of the tubular section within the interior of the bottle and the pressure of the air at the air inlet port plus surface tension forces, assuming the liquid wets the interior passage of the tubular section, plus the weight of the liquid in the tubular section. Gravity aids the flow of liquid into the tubular section as well. The air that displaces the dispensed liquid enters directly into the interior of the bottle during upright operation, but the air bubbles through the liquid when the unit is operated in the inverted position.

The following discussion is concerned with another embodiment wherein the open end of the tubular section is below the liquid level when the bottle is upright.

Figure 10:
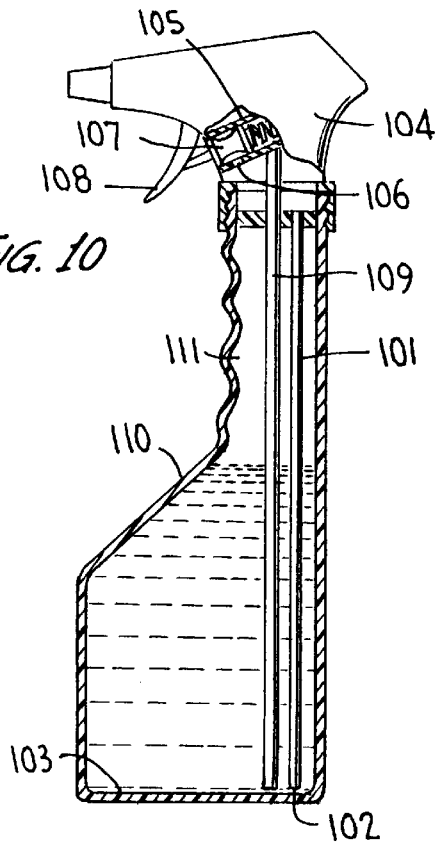
FIG. 10 is a side elevational view, with a portion shown in cutaway cross section, of an upright bottle wherein the tubular section extends to nearly the bottom of the bottle.

Before discussing this further embodiment, it is instructive to review, with the aid of FIG. 10, the operation of the hand pump 104 when operated in the upright position. As has been explained, the hand pump 104 has a trigger 108 that, during the positive dispensing portion of the cycle, moves a piston 107 within a cylinder 105 and compresses a spring (not shown). During this portion of the pumping cycle, the volume of the cylinder 105 is decreased and any liquid contained therein is dispensed. Also during this portion of the pumping cycle, the air inlet port 106 is uncovered so that there is fluid communication between the atmospheric air and the interior of the bottle 110. During this stroke of the pumping cycle, the pressure of the air within the bottle 110 decreases a very slight amount since only a small volume of air is released to the atmosphere and no liquid has yet been drawn out of the interior of the bottle 110. When the trigger 108 is released, the compressed spring forces the piston 107 back to its normal position, enlarging the volume of the cylinder 105 and once again covering the air inlet port 106. During this suction portion of the pumping cycle, liquid is drawn through a feed tube 109 from the interior of the bottle 110 into the cylinder 105 of the hand pump 104, resulting in lowering of the pressure within the bottle 110. It is only the return suction stroke that removes liquid from the interior of the bottle 110 and thus can reduce the pressure therein to the level that causes the atmospheric air to flow into the tubular section 101. During the first portion of the dispensing pumping cycle, more liquid enters the tubular section 101, and that during the later suction portion of the cycle, the pressure in the bottle 110 decreases causing some of the liquid within the tubular section 101 to flow back into the bottle 110. After two complete cycles of a typical hand pump, all of the liquid is removed from the tubular section 101, which in turn is filled with atmospheric air. The pressure of the air within the bottle 110 is decreased to the value of the atmospheric air minus the product of the liquid density times the height of the liquid above the bottom opening 102 of the tubular section 101.

FIG. 10 illustrates a tubular section 101 that has an extreme length so that the bottom opening 102 is at the bottom of the bottle 103 when the bottle is held upright. Before the first operation of the hand pump 104 in an upright orientation (either immediately after inverted operation or with a new bottle), the air in the bottle is at atmospheric pressure. As a result, some of the liquid in the interior of the bottle 110 enters the tubular section 101, as illustrated, in order to compress the air therein to a pressure equal to the atmospheric pressure plus the product of the liquid density times the height of the liquid level in the bottle above the liquid level in the tubular section 101, plus the surface tension effect. When the hand pump 104 is operated during the first positive stroke of the pumping cycle when the volume of the cylinder 105 is being decreased, the contents of the cylinder 105 is dispensed and the air inlet port is uncovered allowing some of the compressed air in the tubular section 101 to escape to the atmosphere. As a result, more liquid enters the tubular section to replace the escaped air. The force moving the liquid into the tubular section when the bottle is upright is the result of the difference between the pressure of the liquid at the bottom entrance 102 of the tubular section 101 (pressure of the air in the bottle plus the product of the liquid density times the height of the liquid level above the tubular section bottom) and the pressure of the air at the air entry port 106 (approximately atmospheric pressure) plus the surface tension force and minus the weight of the liquid within the tubular section. The liquid enters the tubular section 101 against the force of gravity in this case, which is opposite to the condition when the bottle is inverted with the previous embodiments for the tubular section. During the returning suction stroke of the hand pump 104, liquid is drawn from the bottle 110 into the hand pump cylinder 105, thus reducing the pressure within the bottle 110. For a properly sized air inlet port 106 and pumping volume capacity of the hand pump 104, the pressure of the air within the bottle decreases faster during the suction stroke than the decrease of the pressure of the air within the tubular section 101 caused by the escaped air. The result is that liquid is forced out of the tubular section 101 as was described in relation to FIG. 4 for the prior embodiments. For a typical air inlet port diameter of 0.040 inches and a typical hand pump (AFA Corporation or Continental Sprayer, Inc.), additional liquid enters the tubular section during the first dispensing stroke of the hand pump cycle but is forced out of the tubular section 101 during the following suction stroke. All of the liquid is forced out of the tubular section 101 after only two strokes of the typical hand pumps. When the pressure of the air in the bottle 110 decreases below the product of the density of the liquid times the height of the liquid level above the bottom entrance of the 102 of the tubular section 101, atmospheric air enters the bottle 110. At this time, the tubular section 101 contains only air. Unless the bottle 110 is operated in the inverted position, the pressure within the bottle will remain at a value equal to atmospheric minus the product of liquid density and the height of the liquid above the opening 102 at the bottom of the tubular section 101 for all upright operations. The pressure within the bottle 110 continually rises as more liquid is dispensed from the bottle 110, because the head of liquid over the bottom entrance 102 of the tubular section decreases. When the bottle 110 is nearly empty, the pressure therein will be close to atmospheric.

Figure 11:
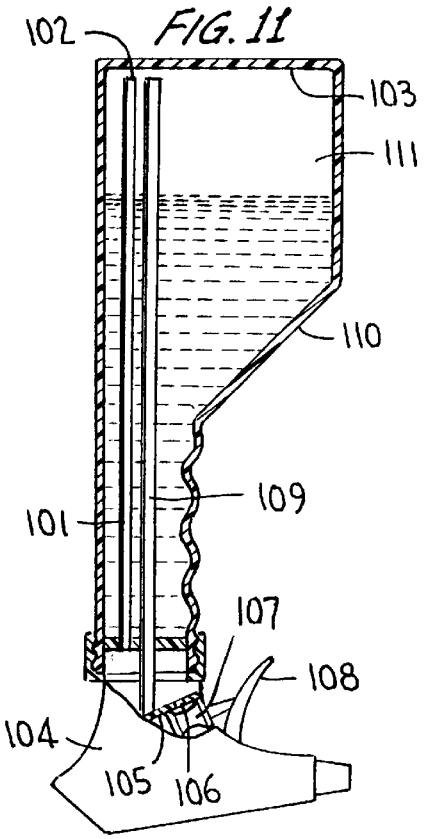
FIG. 11 is a view of the bottle of FIG. 10, but in the inverted position.

When the bottle 110 is inverted, as illustrated in FIG. 11, the opening of the tubular section 102 to the interior of the bottle 110 is above the liquid level, and atmospheric air can enter the interior of the bottle directly to replace the dispensed liquid when the air inlet port 106 is uncovered. During this time, the pressure of the air in the bottle 110 is atmospheric. When the bottle is operated again in the upright position, the air within the tubular section is compressed and the cycle described above is repeated.

As seen in FIGS. 10 and 11, the air to replace the dispensed liquid enters through the tubular section 101 and bubbles through the liquid when the bottle 110 is operated in the upright position and enters the bottle directly when operated in the inverted position. This is opposite to the conditions described for the previous embodiments of the tubular section.

Figure 12:
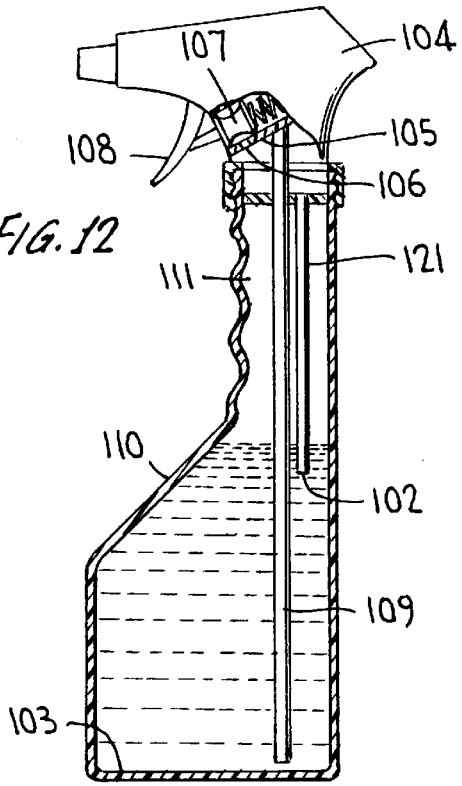
FIG. 12 is a side elevational view, with a portion shown in cutaway cross section, of an upright bottle wherein the tubular section extends about halfway to the bottom of the bottle.
Figure 13:
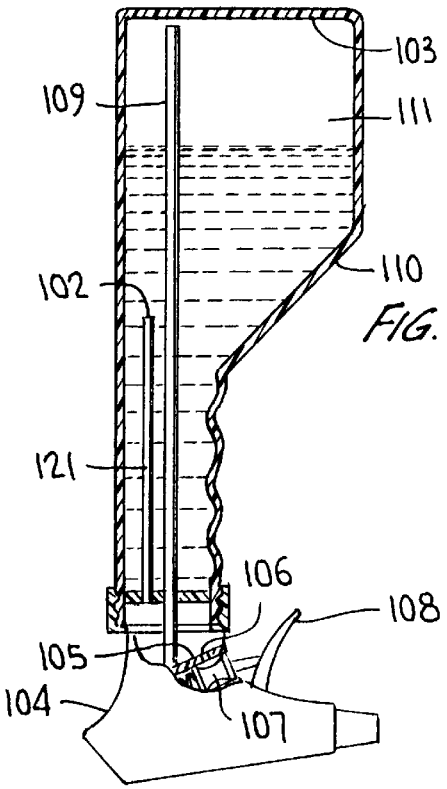
FIG. 13 is a view of the bottle of FIG. 12, but in the inverted position.

FIG. 12 illustrates a shorter tubular section 121 which is immersed in the liquid but does not reach the bottom 103 of the bottle 110 when the bottle is in the upright position. The operation is similar to the previously described tubular sections. The initial compression of the liquid in the tubular section 121 when the bottle 110 is held upright is less than for the long tubular section 101, because the height of the liquid above the tubular section open end 102 is smaller. Also, less liquid enters the tubular section 121 during the first stroke for the same reason. When the bottle operated in the inverted position, as illustrated in FIG. 13, the pressure at the open end of the tubular section 121 is lower than for the embodiments illustrated in FIG. 3, where the tubular section 33 is much shorter and above the liquid level when the bottle is upright because the head of liquid over the open end 102 is smaller. As was the case with the short tubular section 33 illustrated in FIG. 3, the air within the moderate length tubular section 121 acts as a barrier to prevent liquid from reaching the air inlet port 106 and leaking.

Figure 14:
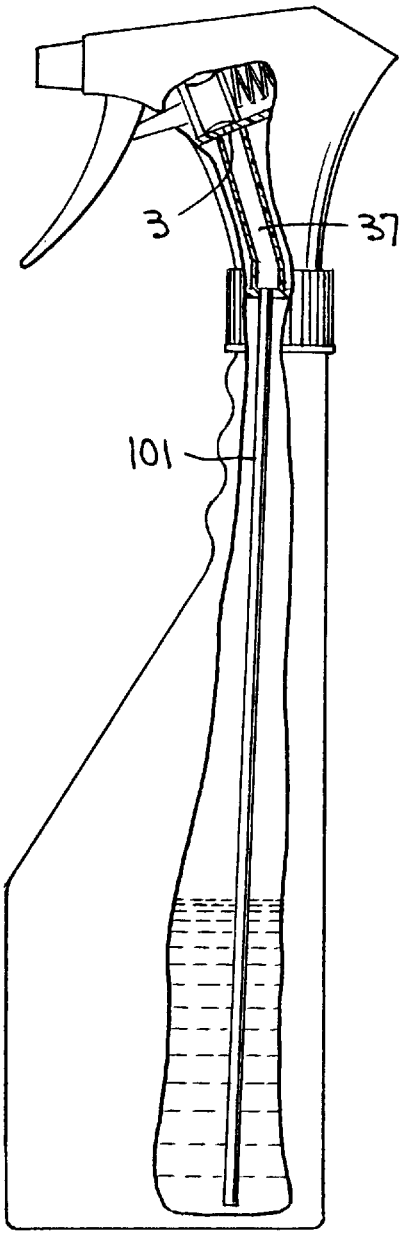
FIG. 14 is a side elevational view, with a portion shown in cutaway cross section, of a bottle having a tubular section extending to nearly the bottom of the bottle as in FIG. 10, but additionally with an annular air passage as in FIG. 7.
Figure 15:
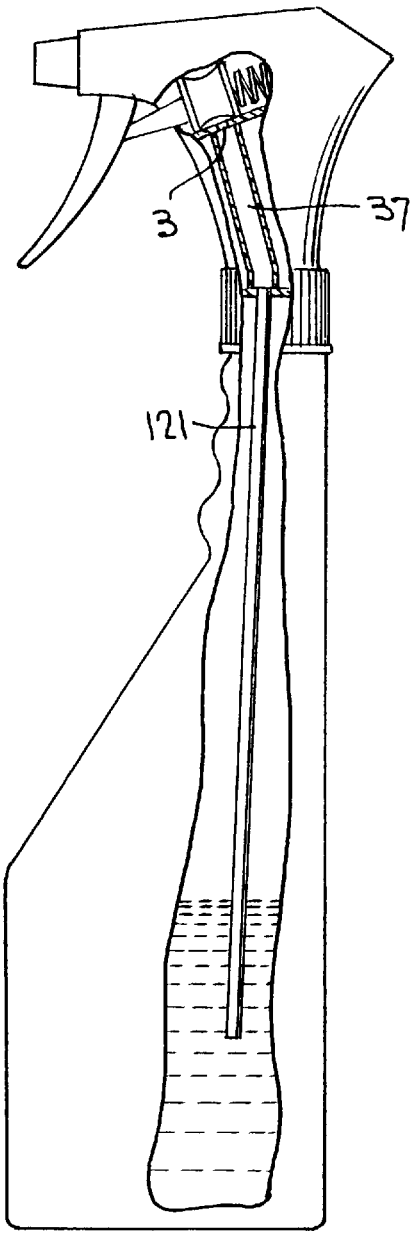
FIG. 15 is a side elevational view, with a portion shown in cutaway cross section, of a bottle having a tubular section extending about halfway to the bottom of the bottle as in FIG. 12, but additionally with an annular air passage as in FIG. 7.

FIGS. 14 and 15 illustrate the leak-resistant spray bottle when the tubular section extends into the liquid contents of the bottle with the embodiment having a volume 37 between the tubular section 33 and the air inlet port 3.

To this point, the discussion has been directed to spray bottles that have rigid walls so that the internal volume does not change as a function of the internal pressure. For some plastic bottles with thin, flat-sided walls, the internal volume will decrease as the internal pressure is decreased. The result is that the internal pressure of the flexible-walled bottle does not decrease as much as the internal pressure of the rigid-walled bottle when a given volume of liquid is removed. Tests with a 32 fluid ounce Fantastik bottle have indicated that more than five times the volume of liquid has to be removed from the bottle compared to a rigid-walled bottle to reduce the pressure to the same level.

A simple test may be conducted to determine the bounding maximum size of the tubular section for any particular plastic bottle with non-rigid walls. The bottle has its normal opening closed with just a small orifice opening whose diameter is such that air will not bubble through the liquid, typically less than 0.25 inches. The bottle is approximately one-half full of liquid, since this is the most severe case and will exhibit the largest leakage of liquid. With the bottle inverted so that the normal bottom is now uppermost, the liquid will flow out of the bottle until the air pressure therein is reduced by the amount equal to the product of the density of the liquid times the height of the liquid. This amount of liquid that flows out of the bottle is measured, and is the bounding maximum value of the volume of the tubular section that is needed to prevent liquid from leaking out of the bottle during inverted operation. The actual volume of the tubular section is smaller than the amount determined by this test since the amount of liquid that is dispensed by the hand pump is assumed to be zero for this estimate. To determine the actual minimum volume of the tubular section, it is necessary to know the rate at which the air escapes from the tubular section to the atmosphere and the rate at which liquid is pumped out of the bottle as has been discussed previously.

If the bottle is particularly flexible, the tubular section would have to be so long that it would reach into the liquid when the bottle is held in an upright position. The embodiment illustrated in FIG. 10, where the air tubular section reaches near the bottom of the bottle, would be the most preferred design for use with flexible-walled bottles.

This invention is not to be limited by the embodiments shown in the drawings and described in the description, which are given by way of example and not of limitation, but only in accordance with the appended claims.

What is claimed is:

1. A hand-pump spray bottle that will not leak liquid through the air inlet port if operated when the bottle is oriented so that the air inlet unit is covered with liquid, comprising:

a bottle having a wall forming a storage cavity with an opening through said wall into said cavity to which a hand pump is mounted, said hand pump being in fluid communication with a feed tube extending into the liquid that is to be dispensed and is contained in said cavity, said hand pump being configured so that, when operated, an air inlet port is uncovered in order to admit air that will replace the liquid that is dispensed; and an air inlet unit including said air inlet port, said inlet port being in circuit with a tubular section having an open end, said tubular section being sized so as to act as a reservoir to hold any of said liquid that flows out of said storage cavity and into it during operation of said hand pump when said air inlet unit is covered with said liquid until the pressure of the air within said storage cavity is decreased by an amount equal to the density of said liquid times the height of said liquid above said air inlet unit as the result of removing some of the liquid contained in said storage cavity at which time atmospheric air can enter said air inlet port and maintain the pressure in said bottle constant thereafter.

2. The hand-pump spray bottle of claim 1, wherein said hand pump is sized so that it dispenses a greater volume of liquid than the volume of air that is released to the atmosphere through said inlet port during each stroke of said hand pump.

3. The hand-pump spray bottle of claim 1, wherein said air inlet port is sized so that the volume of air that is released to the atmosphere when said air inlet port is uncovered is smaller than the volume of liquid that is discharged from the hand pump.

4. The hand-pump spray bottle of claim 1, wherein the air inlet unit is positioned within said hand pump.

5. The hand-pump spray bottle of claim 1, wherein said tubular section is positioned with said storage cavity.

6. The hand-pump spray bottle of claim 1, wherein said tubular section is a single tube extending from said air inlet port in said hand pump.

7. The hand-pump spray bottle of claim 1, wherein the tubular section has a circular cross section.

8. The hand-pump spray bottle of claim 1, wherein the tubular section has a noncircular cross section.

9. The hand-pump spray bottle of claim 1, wherein the tubular section comprises at least two tubes.

10. The hand-pump spray bottle of claim 1, wherein the greatest internal cross-sectional dimension of the tubular section is smaller than about 0.25 inches.

11. The hand-pump spray bottle of claim 1, wherein the length of the tubular section is greater than about ¼ inch.

12. The hand-pump spray bottle of claim 1, wherein the open end of the tubular section within the bottle is above the liquid when the bottle contains a full capacity of liquid and is in the upright position.

13. The hand-pump spray bottle of claim 1, wherein the open end of the tubular section is located at the bottom of the interior cavity of the bottle when the bottle is in the upright position.

14. A hand-pump spray bottle that will not leak liquid through the air inlet port if operated when the bottle is oriented so that the air inlet unit is covered with liquid, comprising:

a bottle having a wall forming a storage cavity with an opening through said wall into said cavity to which a hand pump is mounted, said hand pump being in fluid communication with a feed tube extending into the liquid that is to be dispensed and is contained in said cavity, said hand pump being configured so that, when operated, an air inlet port is uncovered in order to admit air that will replace the liquid that is dispensed; and an air inlet unit that comprising said air inlet port, said inlet port being in circuit with a tubular section which in turn is in circuit with a void volume, said tubular section having an open end located at the top of said void volume when said bottle is in the inverted position so that said open end is above the liquid in said void volume, said void volume having an open end in fluid communication with said storage cavity, said void volume being sized so as to act as a reservoir to hold any of said liquid that flows out of said storage cavity and into it during operation of said hand pump when said air inlet unit is covered with said liquid until the pressure of the air within said storage cavity is decreased by an amount equal to the density of said liquid times the height of said liquid above said air inlet unit as the result of removing some of the liquid contained in said storage cavity at which time atmospheric air can enter said air inlet port and maintain the pressure in said bottle constant thereafter.

15. The hand-pump spray bottle of claim 14, wherein said hand pump is sized so that it dispenses a greater volume of liquid than the volume of air that is released to the atmosphere through said inlet port during each stroke of said hand pump.

16.The hand-pump spray bottle of claim 14, wherein said air inlet port is sized so that the volume of air that is released to the atmosphere when said air inlet port is uncovered is smaller than the volume of liquid that is discharged from the hand pump.

17. The hand-pump spray bottle of claim 14, wherein said void volume is of any shape and has an orifice in fluid communication with said storage cavity.

18. The hand-pump spray bottle of claim 14, wherein said void volume is of any shape extending from said air inlet port in circuit with the tubular section extending into the interior of said storage cavity.

19. The hand-pump spray bottle of claim 14, wherein the tubular section has a circular cross section.

20. The hand-pump spray bottle of claim 14, wherein the tubular section has a noncircular cross section.

21. The hand-pump spray bottle of claim 14, wherein the tubular section comprises at least two tubes.

22. The hand-pump spray bottle of claim 14, wherein the greatest internal cross-sectional dimension of the tubular section is smaller than about 0.25 inches.

23. The hand-pump spray bottle of claim 14, wherein the length of the tubular section is greater than about ¼ inch.

24. The hand-pump spray bottle of claim 14, wherein the open end of the tubular section is located between the bottom of the interior cavity of the bottle and the liquid surface when the bottle contains a full capacity of liquid and is in the upright position.

25. The hand-pump spray bottle of claim 14, wherein the open end of the tubular section within the bottle is above the liquid when the bottle contains a full capacity of liquid and is in the upright position.

26. The hand-pump spray bottle of claim 14, wherein the open end of the tubular section is located at the bottom of the interior cavity of the bottle when the bottle is in the upright position.

27. The hand-pump spray bottle of claim 14, wherein the open end of the tubular section is located between the bottom of the interior cavity of the bottle and the liquid surface when the bottle contains a full capacity of liquid and is in the upright position.

28. A hand-pump apparatus operable to pump a liquid of a selected density into an external atmosphere, comprising:

a closed container having a pump head opening therein, the shape of the closed container defining a maximum liquid head dimension above the pump head opening; and a hand-actuated pump unit in fluid communication with the closed container at the pump head opening, the pump head including an air inlet port providing communication between an exterior of the apparatus and the interior of the closed container, a hand-actuated pump operable to pump liquid out of the closed container and which cyclically covers and uncovers the air inlet port during a pump cycle, and means for effecting an air seal between the air inlet port and the liquid within the closed container, when the closed container is oriented such that any liquid therein would otherwise contact the air inlet port, until a gas pressure within the closed container is decreased below atmospheric pressure by an amount equal to the density of the liquid times the maximum liquid head dimension, at which time atmospheric air may enter said air inlet port and maintain the gas pressure within the bottle constant.

* * * * *